US005797282A

United States Patent [19]

Bodin

[11] Patent Number: 5,797,282

[45] Date of Patent: Aug. 25, 1998

[54] METHOD OF UTILIZING A STANDARD CIRCULAR KNITTING MACHINE TO PRODUCE A FABRIC WITH A PATTERN

[76] Inventor: Ted Bodin, 100 Quayside Ter., Miami, Fla. 33138

[21] Appl. No.: 59,981

[22] Filed: Apr. 14, 1998

Related U.S. Application Data

[63] Continuation-in-part of Ser. No. 913,000, Aug. 18, 1997.

[51] Int. Cl.[6] ..... D04B 1/12; D04B 1/00

[52] U.S. Cl. ..... 66/169 R; 66/201; 66/202

[58] Field of Search ..... 66/169 R, 198, 66/170, 200, 201, 202

[56] References Cited

U.S. PATENT DOCUMENTS

| | | |
|---|---|---|
| 2,429,187 | 10/1947 | Krasnov . |
| 2,574,737 | 11/1951 | Goodchild . |
| 2,698,009 | 12/1954 | Cysick . |
| 2,738,566 | 3/1956 | Scott, Jr. . |
| 3,210,964 | 10/1965 | Russell . |
| 3,299,486 | 1/1967 | Meyers et al. . |
| 3,742,732 | 7/1973 | Plath . |
| 4,355,499 | 10/1982 | Takai . |
| 4,523,428 | 6/1985 | Negishi et al. . |
| 4,537,227 | 8/1985 | Ballarati . |
| 4,548,055 | 10/1985 | MacDonald . |
| 4,548,057 | 10/1985 | Essig . |
| 5,038,585 | 8/1991 | Robinson et al. . |
| 5,095,719 | 3/1992 | Philip . |
| 5,331,828 | 7/1994 | Joachimweis et al. . |

OTHER PUBLICATIONS

Lester Mishcon & Abraham Abrams; Pattern Wheel Designing For Circular Jersey Knitting Machines; 1949; pp 27–67; Supreme Knitting Machine Co., Inc; 94 –oz 104th Street—Ozone Park 16, N.Y.; 105 Johnson Avenue —Brooklyn 6, N.Y.

*Primary Examiner*—John J. Calvert

[57] ABSTRACT

A method of utilizing a standard circular knitting machine to produce a fabric with a pattern by the combination of selectively rendering specific needles of the standard circular knitting machine inoperative, removing pre-selected needles in a predetermined manner from the cylinder of the knitting machine, using yarns of the type including S-twist, Z-twist, colored, and textured, and feeding the yarn types, i.e. z and s-twist yarns, in alternating manner with a predetermined length of yarn of each type.

6 Claims, 6 Drawing Sheets

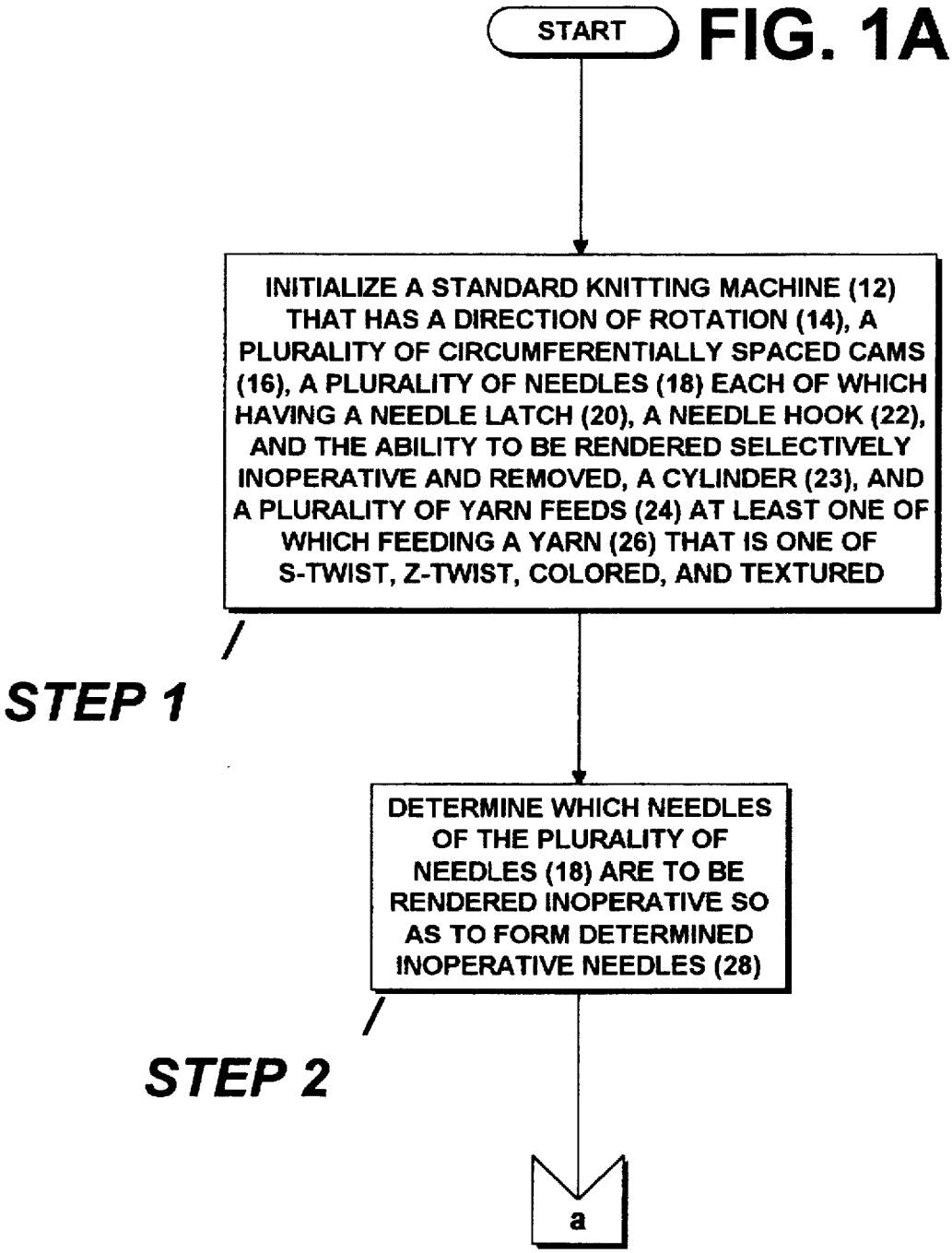
START
FIG. 1A
INITIALIZE A STANDARD KNITTING MACHINE (12) THAT HAS A DIRECTION OF ROTATION (14), A PLURALITY OF CIRCUMFERENTIALLY SPACED CAMS (16), A PLURALITY OF NEEDLES (18) EACH OF WHICH HAVING A NEEDLE LATCH (20), A NEEDLE HOOK (22), AND THE ABILITY TO BE RENDERED SELECTIVELY INOPERATIVE AND REMOVED, A CYLINDER (23), AND A PLURALITY OF YARN FEEDS (24) AT LEAST ONE OF WHICH FEEDING A YARN (26) THAT IS ONE OF S-TWIST, Z-TWIST, COLORED, AND TEXTURED
STEP 1
DETERMINE WHICH NEEDLES OF THE PLURALITY OF NEEDLES (18) ARE TO BE RENDERED INOPERATIVE SO AS TO FORM DETERMINED INOPERATIVE NEEDLES (28)
STEP 2
a

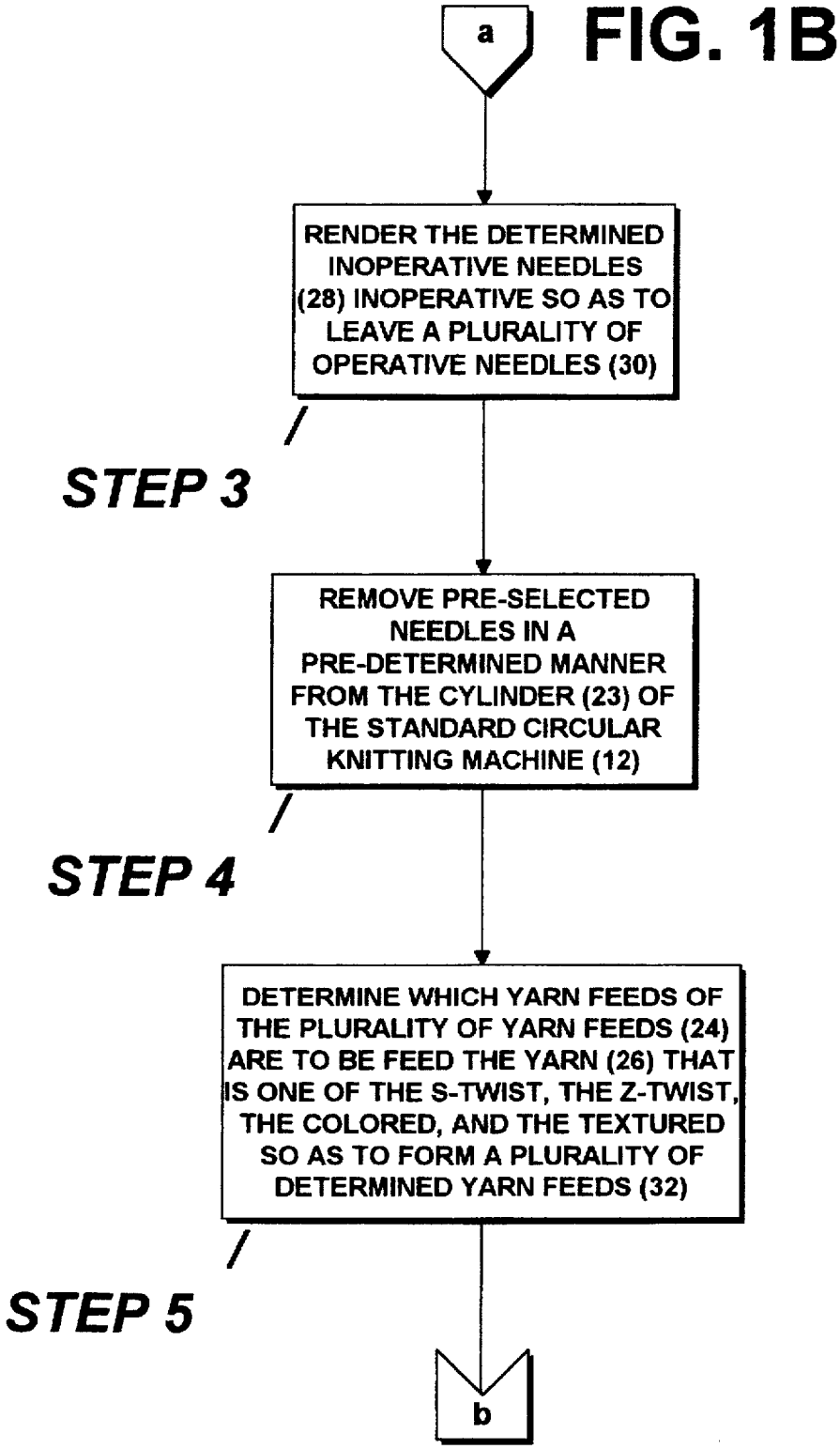
a
FIG. 1B
RENDER THE DETERMINED INOPERATIVE NEEDLES (28) INOPERATIVE SO AS TO LEAVE A PLURALITY OF OPERATIVE NEEDLES (30)
STEP 3
REMOVE PRE-SELECTED NEEDLES IN A PRE-DETERMINED MANNER FROM THE CYLINDER (23) OF THE STANDARD CIRCULAR KNITTING MACHINE (12)
STEP 4
DETERMINE WHICH YARN FEEDS OF THE PLURALITY OF YARN FEEDS (24) ARE TO BE FEED THE YARN (26) THAT IS ONE OF THE S-TWIST, THE Z-TWIST, THE COLORED, AND THE TEXTURED SO AS TO FORM A PLURALITY OF DETERMINED YARN FEEDS (32)
STEP 5
b

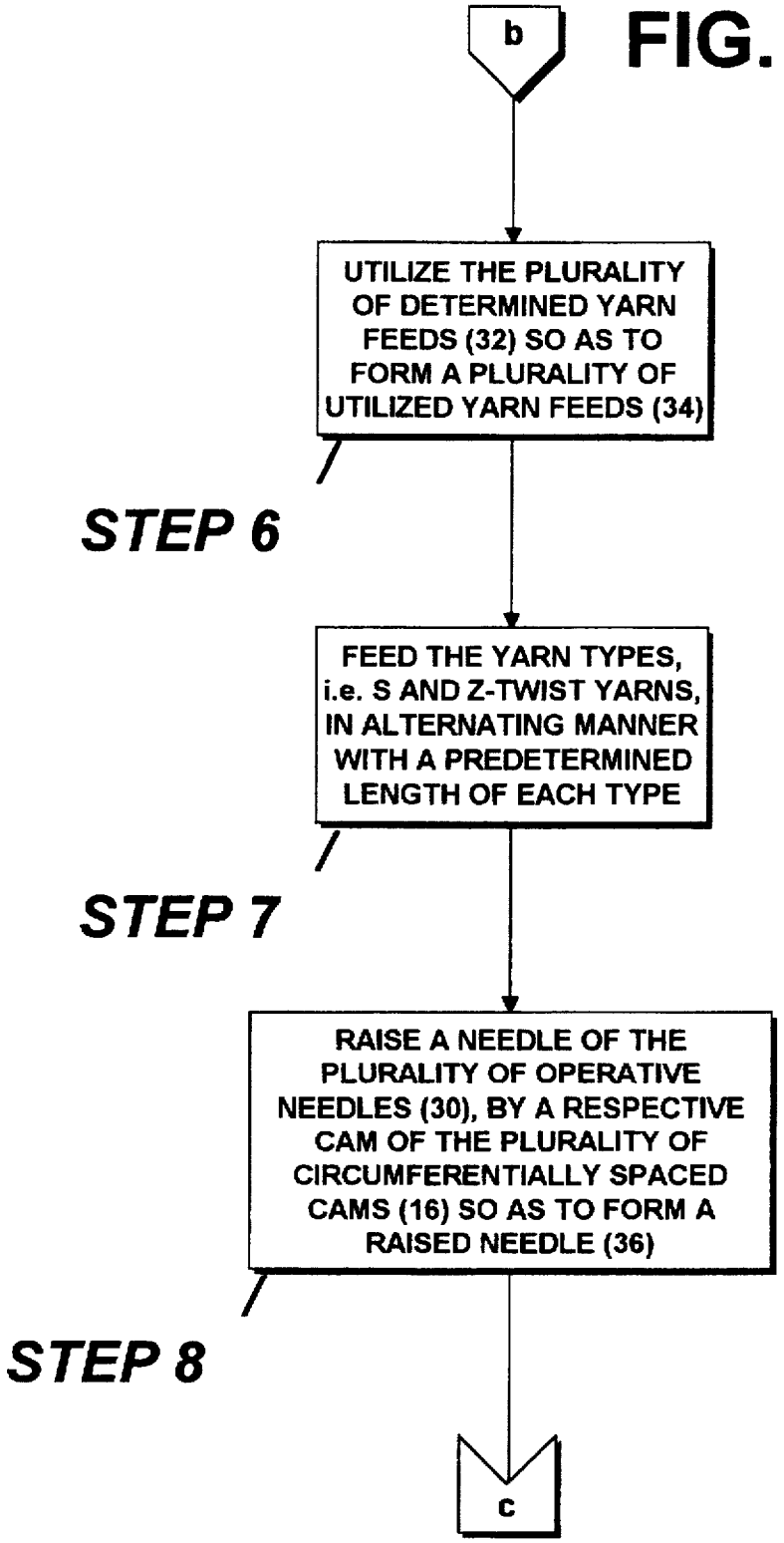
b
FIG. 1C
UTILIZE THE PLURALITY OF DETERMINED YARN FEEDS (32) SO AS TO FORM A PLURALITY OF UTILIZED YARN FEEDS (34)
STEP 6
FEED THE YARN TYPES, i.e. S AND Z-TWIST YARNS, IN ALTERNATING MANNER WITH A PREDETERMINED LENGTH OF EACH TYPE
STEP 7
RAISE A NEEDLE OF THE PLURALITY OF OPERATIVE NEEDLES (30), BY A RESPECTIVE CAM OF THE PLURALITY OF CIRCUMFERENTIALLY SPACED CAMS (16) SO AS TO FORM A RAISED NEEDLE (36)
STEP 8
c c OPEN THE NEEDLE LATCH (20) OF THE RAISED NEEDLE (36), BY A STITCH LOOP (38) DISPOSED IN THE NEEDLE HOOK (22) OF THE RAISED NEEDLE (36) BEFORE THE RAISED NEEDLE (36) WAS RAISED
STEP 9
HOLD DOWN THE STITCH LOOP (38) IN THE NEEDLE HOOK (22) OF THE RAISED NEEDLE (36)
STEP 10
DRAW DOWN THE RAISED NEEDLE (36) SO AS TO FORM A LOWERED NEEDLE (40)
STEP 11
d

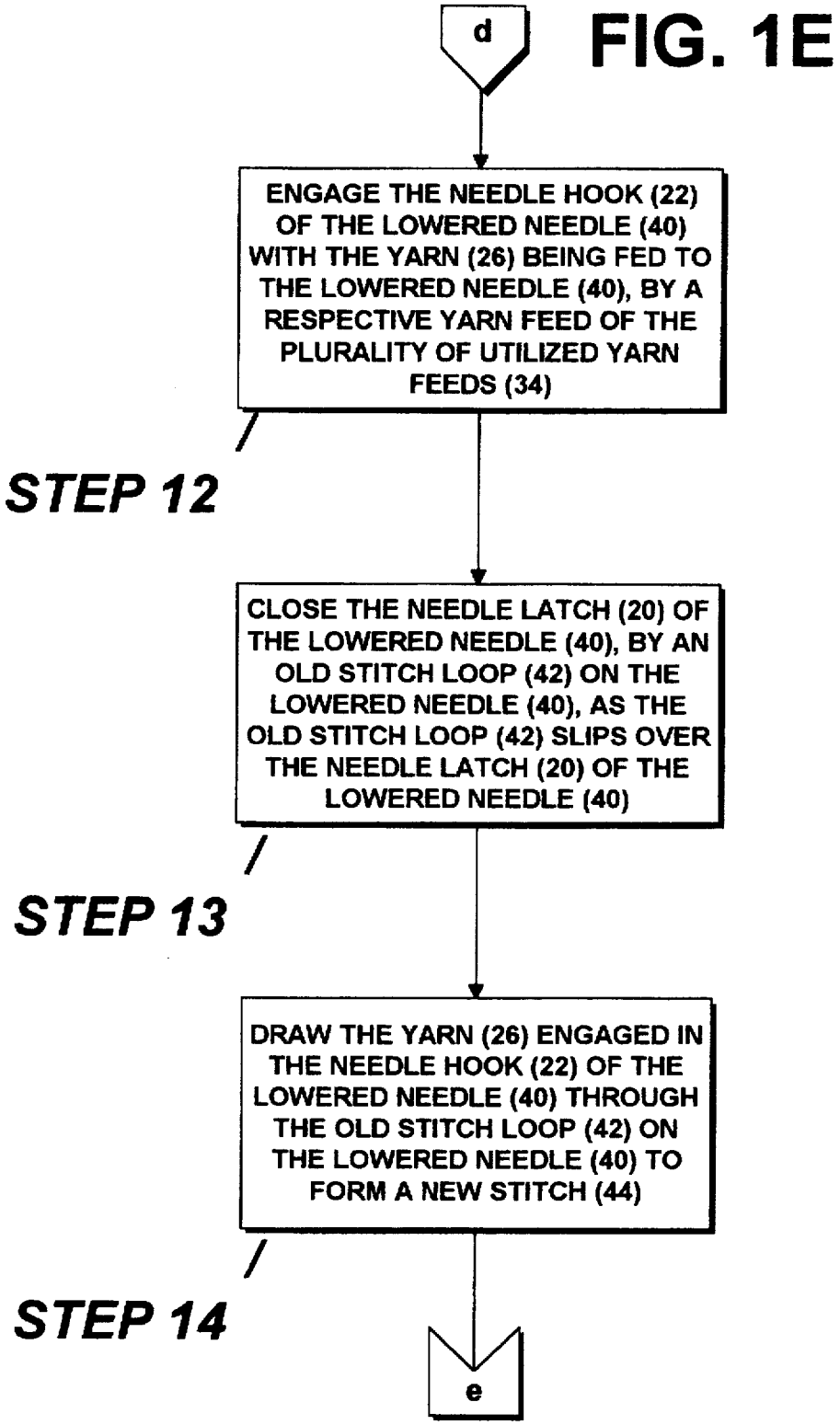
d
FIG. 1E
ENGAGE THE NEEDLE HOOK (22) OF THE LOWERED NEEDLE (40) WITH THE YARN (26) BEING FED TO THE LOWERED NEEDLE (40), BY A RESPECTIVE YARN FEED OF THE PLURALITY OF UTILIZED YARN FEEDS (34)
STEP 12
CLOSE THE NEEDLE LATCH (20) OF THE LOWERED NEEDLE (40), BY AN OLD STITCH LOOP (42) ON THE LOWERED NEEDLE (40), AS THE OLD STITCH LOOP (42) SLIPS OVER THE NEEDLE LATCH (20) OF THE LOWERED NEEDLE (40)
STEP 13
DRAW THE YARN (26) ENGAGED IN THE NEEDLE HOOK (22) OF THE LOWERED NEEDLE (40) THROUGH THE OLD STITCH LOOP (42) ON THE LOWERED NEEDLE (40) TO FORM A NEW STITCH (44)
STEP 14
e e SHED THE OLD STITCH LOOP (42), HELD DOWN AS THE LOWERED NEEDLE (40) IS RAISED, FROM THE LOWERED NEEDLE (40)
STEP 15
REPEAT STEP 8 TO STEP 15 PROGRESSIVELY, ONE NEEDLE OF THE PLURALITY OF OPERATIVE NEEDLES (30) AFTER THE OTHER, AS THE STANDARD KNITTING MACHINE (12) ROTATES SO AS TO KNIT A SUBSTANTIAL LENGTH OF THE FABRIC WITH THE PATTERN
STEP 16
END

METHOD OF UTILIZING A STANDARD CIRCULAR KNITTING MACHINE TO PRODUCE A FABRIC WITH A PATTERN

CROSS REFERENCE TO RELATED APPLICATIONS

The instant application is a Continuation-in-Part of application Ser. No. 08/913,000 filed Aug. 18, 1997, which is to be expressly abandoned when the instant application is accorded a filing date.

BACKGROUND OF THE INVENTION

1. Field of the Invention

The present invention relates to a method of producing a fabric with a pattern. More particularly, the present invention relates to a method of utilizing a standard circular knitting machine to produce a fabric with a pattern.

2. Description of the Prior Art

Knitting machines are available to specifically knit patterns on any type of cloth. They, however, are quite expensive and complex to operate. In contradistinction, however, standard circular knitting machines knit jerseys, but cannot knit with patterns.

Numerous innovations for knitting machines have been provided in the prior art that will be described. Even though these innovations may be suitable for the specific individual purposes to which they address, however, they differ from the present invention.

FOR EXAMPLE, U.S. Pat. No. 3,742,732 to Plath teaches a method of and apparatus for increasing the number of control signals from Jacquard pattern control mechanism to circular knitting machines. Two different kinds of needle jacks are employed, such jacks of different types being used in pairs having one of each type of jack. For each knitting system there is provided two pattern selection stations or positions of which at least one affords the selection of both needle jack types. Each needle selection station activates at all times only one of both needle jacks types.

ANOTHER EXAMPLE, U.S. Pat. No. 5,095,719 to Philip teaches an apparatus for knitting intarsia design jersey knit fabric on a circular knitting machine capable of knitting single jersey fabric. The apparatus includes pushers for raising the needles, a knitting cam for drawing the raised needles, one after the other, down, yarn feeds for feeding yarn to the raised needles, pusher cams for raising and lowering the pushers, a reciprocating drive for reciprocating the knitting cam, back and forth, around the cylinder to draw the needles down after they are raised by the pushers, a drive for repositioning the yarn feeds and for reversing the direction of reciprocation of the knitting cam after the raised needles of a first and next group of needles have been raised and drawn down, the knitting cam has cleared such needles and the yarn feeds have been repositioned.

FINALLY, STILL ANOTHER EXAMPLE, U.S. Pat. No. 5,331,828 to Weis et al. teaches a warp knitting machine for making warp knitted goods. The machine comprises, in addition to a guide bar for the formation of the ground fabric, two pattern forming jacquard controlled guide bars whose guide to guide spacing is twice as large as the space between the needles of the needle bed.

It is apparent that numerous innovations for knitting machines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a method of utilizing a standard circular knitting machine to produce a fabric with a pattern that avoids the disadvantages of the prior art.

ANOTHER OBJECT of the present invention is to provide a method of utilizing a standard circular knitting machine to produce a fabric with a pattern that is simple and inexpensive to manufacture.

STILL ANOTHER OBJECT of the present invention is to provide a method of utilizing a standard circular knitting machine to produce a fabric with a pattern that is simple to use.

BRIEFLY STATED, YET ANOTHER OBJECT of the present invention is to provide a method of utilizing a standard circular knitting machine to produce a fabric with a pattern by the combination of selectively rendering specific needles of the standard circular knitting machine inoperative, removing pre-selected needles in a predetermined manner from the cylinder of the knitting machine, using yarns of the type including S-twist, Z-twist, colored, and textured, and feeding the yarn types, i.e. z and s-twist yarns, in alternating manner with a predetermined length of yarn of each type.

The novel features which are considered characteristic of the present invention are set forth in the appended claims. The invention itself, however, both as to its construction and its method of operation, together with additional objects and advantages thereof, will be best understood from the following description of the specific embodiment when read and understood in connection with the accompanying drawing.

BRIEF DESCRIPTION OF THE DRAWING

The figures of the drawing are described as follows:

FIGS. 1A–1F are the process flow of the present invention.

LIST OF REFERENCE NUMERALS UTILIZED IN THE DRAWING

Figure 1D:
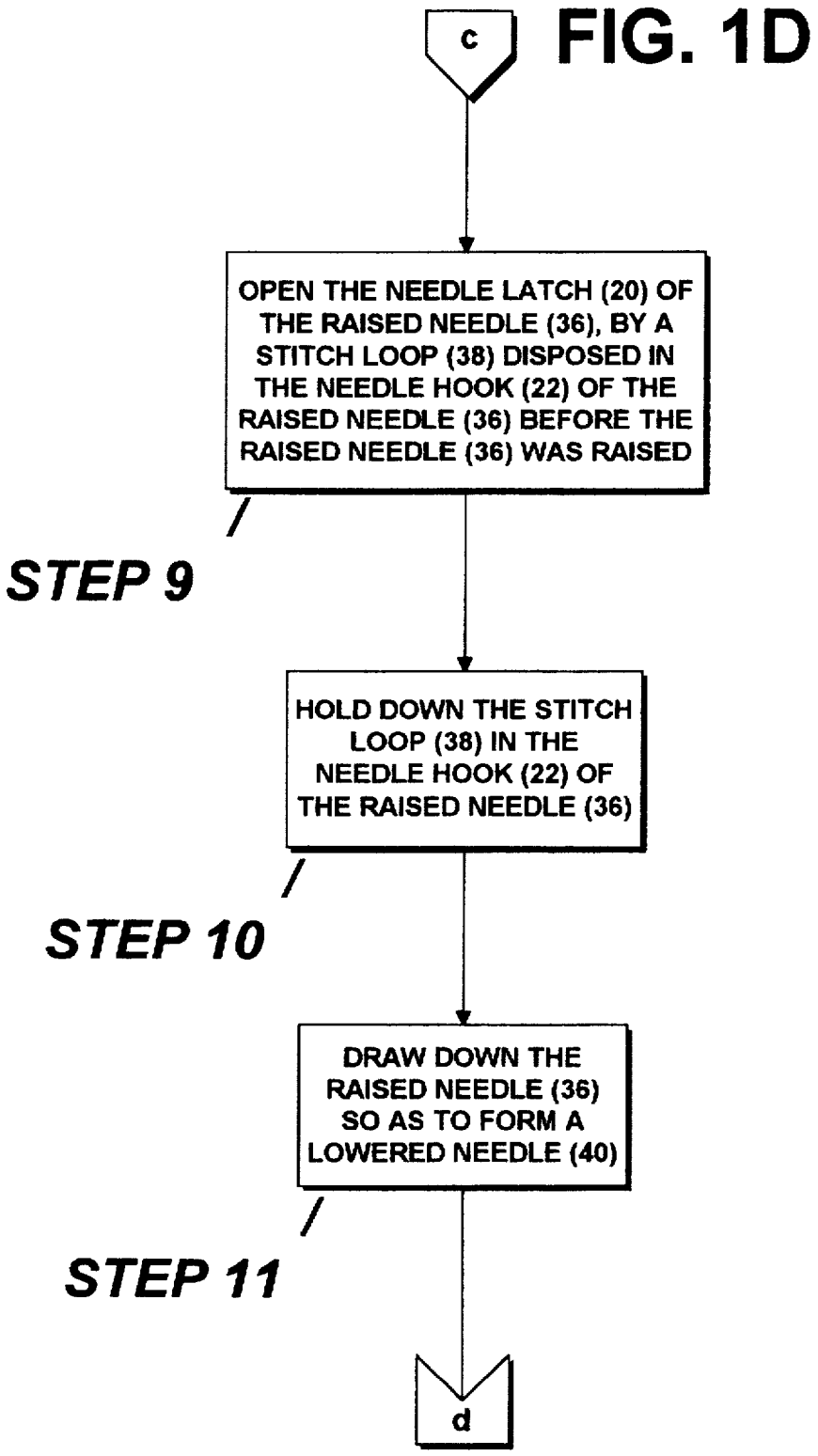

10 method of utilizing a standard circular knitting machine to produce a fabric with a pattern
12 standard circular knitting machine
14 direction of rotation of standard circular knitting machine 12
16 plurality of circumferentially spaced cams of standard circular knitting machine 12
18 plurality of needles of standard circular knitting machine 12
20 needle latch of each needle of plurality of needles 18 of standard circular knitting machine 12
22 needle hook of each needle of plurality of needles 18 of standard circular knitting machine 12
23 cylinder of standard circular knitting machine 12
24 plurality of yarn feeds of standard circular knitting machine 12
26 yarn fed by at least one of plurality of yarn feeds 24 of standard circular knitting machine 12
28 determined inoperative needles of plurality of needles 18 of standard circular knitting machine 12
30 plurality of operative needles of plurality of needles 18 of standard circular knitting machine 12
32 plurality of determined yarn feeds of plurality of yarn feeds 24 of standard circular knitting machine 12
34 plurality of utilized yarn feeds of plurality of determined yarn feeds 32 of plurality of yarn feeds 24 of standard circular knitting machine 12

36 raised needle of plurality of operative needles 30 of plurality of needles 18 of standard circular knitting machine 38 stitch loop in needle hook 22 of raised needle 36 of plurality of operative needles 30 of plurality of needles 18 of standard circular knitting machine 12

40 lowered needle of plurality of operative needles 30 of plurality of needles 18 of standard circular knitting machine 12

42 old stitch loop on lowered needle 40 of plurality of operative needles 30 of plurality of needles 18 of standard circular knitting machine 12

44 new stitch

DETAILED DESCRIPTION OF THE PREFERRED EMBODIMENT

Figure 1F:
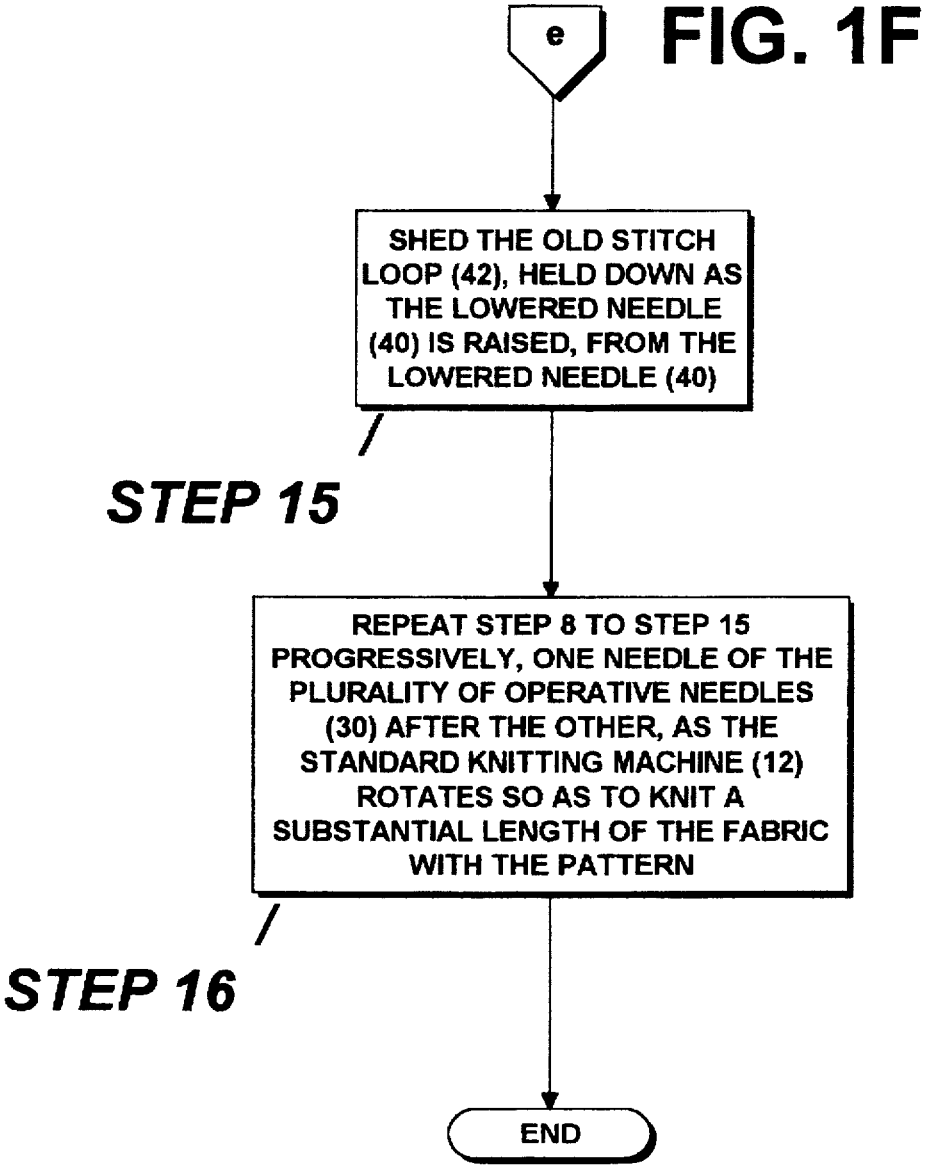

Referring now to FIGS. 1A to 1F, in which like numerals indicate like parts, the method of utilizing a standard circular knitting machine to produce a fabric with a pattern of the present invention is shown at 10 and includes the steps of:

STEP 1: Initialize a standard circular knitting machine 12 that has a direction of rotation 14, a plurality of circumferentially spaced cams 16, a plurality of needles 18 each of which having a needle latch 20, a needle hook 22, and the ability to be rendered selectively inoperative and removed, a cylinder 23, and a plurality of yarn feeds 24 at least one of which feeding a yarn 26 that is one of S-twist, Z-twist, colored, and textured.

STEP 2: Determine which needles of the plurality of needles 18 are to be rendered inoperative so as to form determined inoperative needles 28.

STEP 3: Render the determined inoperative needles 28 inoperative so as to leave a plurality of operative needles 30.

STEP 4: Remove pre-selected needles in a pre-determined manner from the cylinder 23 of the standard circular knitting machine 12.

STEP 5: Determine which yarn feeds of the plurality of yarn feeds 24 are to feed the yarn 26 that is one of the S-twist, the Z-twist, the colored, and the textured so as to form a plurality of determined yarn feeds 32.

STEP 6: Utilize the plurality of determined yarn feeds 32 so as to form a plurality of utilized yarn feeds 34.

STEP 7: Feed the yarn types, e.g. z and s-twist yarns, in alternating manner with a predetermined length of yarn of each type.

STEP 8: Raise a needle of the plurality of operative needles 30, by a respective cam of the plurality of circumferentially spaced cams 16 so as to form a raised needle 36.

STEP 9: Open the needle latch 20 of the raised needle 36, by a stitch loop 38 disposed in the needle hook 22 of the raised needle 36 before the raised needle 36 was raised.

STEP 10: Hold down the stitch loop 38 in the needle hook 22 of the raised needle 36.

STEP 11: Draw down the raised needle 36 so as to form a lowered needle 40.

STEP 12: Engage the needle hook 22 of the lowered needle 40 with the yarn 26 being fed to the lowered needle 40, by a respective yarn feed of the plurality of utilized yarn feeds 34.

STEP 13: Close the needle latch 20 of the lowered needle 40, by an old stitch loop 42 on the lowered needle 40, as the old stitch loop 42 slips over the needle latch 20 of the lowered needle 40.

STEP 14: Draw the yarn 26 engaged in the needle hook 22 of the lowered needle 40 through the old stitch loop 42 on the lowered needle 40 to form a new stitch 44.

STEP 15: Shed the old stitch loop 42, held down as the lowered needle 40 is raised, from the lowered needle 40.

STEP 16: Repeat STEP 8 to STEP 15 progressively, one needle of the plurality of operative needles 30 after the other, as the standard circular knitting machine 12 rotates so as to knit a substantial length of the fabric with the pattern.

Furthermore, it is to be understood that depending upon cam length, at least a portion of the plurality of operative needles 30 that is disposed in front of a respective portion of the plurality of circumferentially spaced cams 16 in the direction of rotation 14 of the standard circular knitting machine 12 are in progressive positions of being raised while another portion of the plurality of operative needles 30 that is disposed in back of another respective portion of the plurality of circumferentially spaced cams 16 are in progressive positions of being drawn down.

It will be understood that each of the elements described above, or two or more together, may also find a useful application in other types of constructions differing from the types described above.

While the invention has been illustrated and described as embodied in a method of utilizing a standard circular knitting machine to produce a fabric with a pattern, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method of utilizing a standard circular knitting machine to produce a fabric with a pattern, comprising the steps of:

a) initializing the standard circular knitting machine to have a direction of rotation, a cylinder, a plurality of circumferentially spaced cones of yarn, a plurality of needles, each of the needles has a needle latch, a needle hook, and the ability of being rendered selectively inoperative, and a plurality of yarn feeds at least one of which feeds a yarn being one of S-twist, Z-twist, colored, and textured;

b) determining which of the needles are to be rendered inoperative so as to form determined inoperative needles;

c) rendering said determined inoperative needles so as to leave a plurality of operative needles;

d) removing pre-selected needles in a predetermined manner from the cylinder of the knitting machine;

e) determining which of the of yarn feeds are to feed the at least one yarn of the S-twist, Z-twist, colored, and textured so as to form a plurality of determined yarn feeds;

f) utilizing said plurality of determined yarn feeds so as to form a plurality of utilized yarn feeds;

g) feeding the yarn types in alternating manner with a predetermined length of yarn of each type;

h) raising a needle of said plurality of operative needles, by a respective cam so as to form a raised needle of said plurality of operative needles;

i) opening said needle latch of said raised needle, by a stitch loop disposed in said needle hook of said raised needle;

j) holding down the stitch loop in said needle hook of said raised needle;

k) drawing down said raised needle so as to form a lowered needles;

l) engaging said needle hook of said lowered needle with the yarn;

m) closing said needle latch of said lowered needle by sliding over old stitch loop;

n) drawing the yarn engaged in said needle hook through the old stitch loop on said lowered needle to form a new stitch;

o) shedding the old stitch loop from said lowered needle; and p) repeating steps h)–o) progressively, one needle after the other as said standard circular knitting machine rotates.

2. The method as defined in claim 1, wherein at least a portion of said plurality of operative needles that is disposed in front of a respective portion of circumferentially spaced cams are in progressive positions of being raised, while another portion of said plurality of operative needles that is disposed in back of another respective portion of circumferentially spaced cams are in progressive positions of being drawn down.

3. The method as defined in claim 1, wherein said yarn fed by said at least one of said plurality of yarn feeds is said S-twist.

4. The method as defined in claim 1, wherein said yarn fed by said at least one of said plurality of yarn feeds is said Z-twist.

5. The method as defined in claim 1, wherein said yarn fed by said at least one of said plurality of yarn feeds is said colored.

6. The method as defined in claim 1, wherein said yarn fed by said at least one of said plurality of yarn feeds is said textured.

* * * * *